United States Patent [19]

Wehren et al.

[11] 3,948,448

[45] Apr. 6, 1976

[54] METHOD FOR THE FINE COMMINUTION OF SOLID MATERIALS WITH A ROLLING MILL AND COMMINUTION DEVICE FOR CARRYING OUT THE METHOD

[75] Inventors: Peter Wehren, Zum Steinrutsch; Heinz Meder, Im Kauelchen, both of Germany

[73] Assignee: Klockner-Humboldt-Deutz Aktiengesellschaft, Germany

[22] Filed: Aug. 1, 1974

[21] Appl. No.: 493,553

[30] Foreign Application Priority Data

Aug. 18, 1973 Germany ..... 2341867

[52] U.S. Cl. ..... 241/18; 241/42; 241/62; 241/224; 241/227

[51] Int. Cl.[2] ..... B02C 23/40

[58] Field of Search ..... 241/18, 30, 41, 42, 57, 241/62, 221, 222, 224, 225, 227, 230

[56] References Cited

UNITED STATES PATENTS

| | | | |
|---|---|---|---|
| 291,018 | 1/1884 | Ager | 241/57 |
| 2,221,802 | 11/1940 | Keys | 241/42 X |
| 2,986,348 | 5/1961 | Noll et al. | 241/222 |
| 3,226,042 | 12/1965 | Adamski et al. | 241/222 X |
| 3,627,555 | 12/1971 | Driscoll | 241/18 X |

*Primary Examiner*—Granville Y. Custer, Jr.
*Attorney, Agent, or Firm*—Hill, Gross, Simpson, Van Santen, Steadman, Chiara & Simpson

[57] ABSTRACT

An improved comminuting rolling mill wherein a solid material such as mineralic loose or bulk materials are introduced into a gap between opposed parallel counter rotating comminuting rollers with the material being supplied by a delivery device above the rollers having a discharge slot extending the length of the gap between the rollers and being provided with means for accelerating the charging material to the speed of roller surface travel, with the delivery device having opposed porous walls and having means for supplying a flow of air through said walls for fluidizing the material so that fluidized material flows into the gap between rollers and the device being provided for pressurizing the delivery device so that the material is carried between the rollers at the desired speed.

9 Claims, 2 Drawing Figures

METHOD FOR THE FINE COMMINUTION OF SOLID MATERIALS WITH A ROLLING MILL AND COMMINUTION DEVICE FOR CARRYING OUT THE METHOD

BACKGROUND OF THE INVENTION

The invention relates to a method for the comminution and particularly for the fine comminution of solid material with a rolling mill. More particularly, the invention relates to a method and mechanism for fluidizing a particulate material, directing the fluidized material under pressure into the roller gap so it is essentially squirted therein and further aiding the high velocity entering of the gap by entraining the material with a further flow of compressed air.

An economical comminution with the aid of rolling mills is possible only when the comminution rollers are driven with a sufficiently high circumferential speed. An essential problem exists in that the material to be comminuted should be supplied in a distributed manner uniformly over the entire width of the rollers so that the roller gap and the quantity charged can be related for optimum grinding effect. That is, the rollers must be positioned apart the proper distance relative to the particulate size of the material, and the amount of material introduced into the gap. This insures uniform treatment of the material across the length of the gap so that different effects are not attained along the gap and a compacting or compression and briquetting does not occur.

In accordance with the principles of the present invention, nonuniform comminuting and briquetting are avoided by introducing the charging material into the roller gap at a speed which is at least 80 per cent, and should be over 50 per cent of the rotational surface speed of the rolls. Generally, a material speed which is approximately equal to the circumferential speed of the grinding rolls is used. Also, the grinding rolls should have a circumferential speed of at least 4 m/sec. With the arrangement, the control of the charging quantity is obtained in a manner which prevents sloping out or nonuniform grinding along the width of the roller gap and also prevents conglomeration or briquetting or pressing of the material so that a uniform comminuted product results, rather than one which is lumpy and briquetted. Further, the charging material, in accordance with the present invention, is accelerated or propelled into the gap uniformly over the entire width of the roller gap in a manner wherein there is a homogeneous distribution of material over the entire roller length to obtain optimum grinding output. This presents advantages, particularly for the comminution of a charging material in the fine grain area, for example, with grain size below 1 min.

The acceleration or propelling of the charging material into the gap can be done by charging devices which operate mechanically, such as centrifugal devices. However, in a preferred embodiment of the invention, the charging material is accelerated and propelled by means of compressed air. An advantage of this lies in obtaining high acceleration of the material supplied for the roller gap in a simple manner whereby the air effectively supports the uniform distribution of the charging quantity over the entire length of the roller gap.

In accordance with the structure and method of the present invention, the circumferential speed of the grinding rollers should be at least 8 m/sec., and more advantageously, 10 m/sec. and higher with a range of over 8 m/sec. being preferred. Speed of introduction of material to the roller gap corresponds to the speed of the roller surface and is at least 80 per cent of the circumferential speed of the grinding rollers. Advantages of the present invention attain more economical grinding through the use of higher speed grinding rollers.

It is accordingly an object of the present invention to provide an improved comminuting device wherein a charging material is fluidized in the area of the feed to roller gap by means of compressed air. A further object is to provide a uniform and regulatable density of the charging material by such fluidizing so that optimum grinding output is attainable, and briquetting or compacting of portions of the material is prevented.

In accordance with the invention to increase the output of comminuted material, the charging material is preferably sifted before being supplied to the roller gap, and the fine portions which are sufficiently fine to be regarded as a finished product are withdrawn before passage through the rolling mill.

In accordance with the present invention, the structure has a rolling mill and a charging device wherein the roller gap is arranged horizontally and a delivery slot is positioned above the gap extending over the entire length thereof. The charging device is provided with means for acceleration of the charging material. In one form acceleration means are provided in the forms of nozzles positioned on at least one side of the material outlet slot of the charging device with the nozzles delivering a flow of compressed air to entrain the fluidized material and further deliver it to the gap at a velocity. With the aid of the nozzles a high acceleration of the charging material is obtained without wear on the parts and without the necessity of providing many mechanical parts or a complex apparatus for charging. Further, the jet effect of the individual nozzles aids in making the distribution of material more uniform across the entire area of the roller gap. In another form the material is accumulated in the charging device and is pressurized from above and is fluidized.

In a preferred embodiment, the comminution device in accordance with the present invention, the charging device in the area directly above the material outlet slot has mechanism for loosening and fluidizing the charging material. Such loosening devices may operate mechanically and have as an objective obtaining a uniform density of distribution for conduction into the slot leading to the roller gap. This enables uniform acceleration of the material for feeding into the roller gap and uniform distribution over the width of the gap. In a preferred arrangement, a pressure chamber is provided for the discharge device wherein its walls are porous and of elastic material with compressed air being delivered through the porous walls to fluidize the material in the chamber.

It is accordingly an object of the present invention to provide an improved comminuting device which comminutes material at a greater capacity and higher speed than heretofore possible, which attains comminution at a more uniform and better distributed rate, and operates without expensive complex material and is capable of continuous operation without servicing and adjustment.

Other objects, advantages and features will become more apparent, as will equivalent devices and methods which are intended to be covered herein, in connection with the teaching of the principles of the invention and the disclosure of the preferred embodiments in the specification, claims, and drawings in which:

IN THE DRAWINGS

FIG. 1 is a diagrammatic drawing partially in vertical section illustrating a two-step operation of the comminution device; and FIG. 2 is a somewhat enlarged diagrammatic view, partially in vertical section showing further details of structure.

DESCRIPTION OF THE PREFERRED EMBODIMENTS

Figure 1:
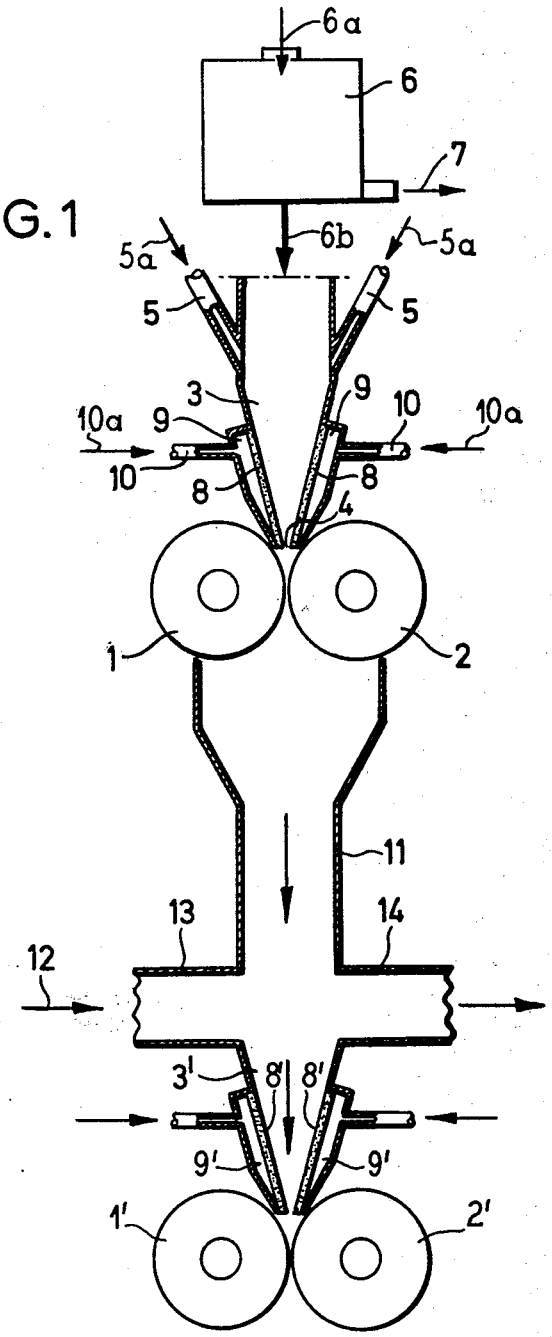

FIG. 1 shows diagrammatically a comminution device for carrying out the method in accordance with the invention wherein a two-step comminution operation is performed. Two opposed rollers, 1 and 2, extend parallel to each other providing a comminution gap therebetween. Positioned directly above the gap is a charging device 3 having a discharge slot 4 which is of uniform width and extends over the entire length of the roller gap. Suitable devices, not shown, are provided for driving the rollers, but in a preferred form only one of the rollers, i.e., roller 1 is driven, and roller 2 is freely rotatable so that it turns with roller 1 with the material passing through the gap.

The charging device is constructed so as to form a downwardly tapering elongate chute with tapered opposing walls 8 containing the material in the chamber 3.

As the material descends through the charging chamber 3, it is accelerated by compressed air entering the charging chamber 3 through compressed air conduits 5 which are angled so as to be directed downwardly in the direction of material flow. A material supply and sifting device 6 is provided and is supplied material from a usual source at its top as indicated by the arrowed line 6*a*. The sifting device is in the form of a screen or other separator of a type which will be known to those versed in the art arranged for separating out the material of a finished size. That is, as the material passes through the separator 6, the particles are sufficiently small so that they need not be comminuted further are withdrawn through the finished product outlet shown by the arrowed line 7.

The coarse material to be comminuted is fed downwardly into the feeding chamber 3 by suitable conduits indicated by the arrowed line 6*b*.

The rollers 1 and 2 are driven at a suitable speed, preferably over 4 m/sec., and are driven at a speed such as 10 m/sec. or higher, depending upon the type of charging material to be handled. Increased speeds can be accommodated in accordance with the present charging device, and with increased speeds, a corresponding increase in output in realized. The coarse material received from the separator 6 will have a granular size of, for example, 2 mm. As the material drops down into the charging chamber 3, it is accelerated and carried forward with the jets of air supplied by the conduits 5. A plurality of uniformly spaced conduits such as 5 may be arranged across the entire width of the charging chamber 3, and these are supplied with compressed air from suitable compressed air source, shown schematically by the arrowed line 5*a*. The compressed air is supplied at a pressure so that the material is picked up and conveyed at a speed approximating the circumferential speed of the rollers. That is, where the rollers operate at 10 m/sec., the material will be delivered at a speed approximately 9 m/sec. to 9.5 m/sec., or slightly faster.

In addition to the material being accelerated by the jets of charging air through the conduits 5, the material is fluidized by air directed through the lower porous portions 8 of the charging chamber. This material is preferably elastic, such as a porous polyethylene and is material which is capable of withstanding the wearing effect of the charging material passing downwardly. However, because a continual flow of air will pass inwardly through the porous walls 8, the wearing effect is maintained at a minimum inasmuch as a blanket of air essentially covers the inner surface of the walls 8, and fluidizes the material in the chamber. Compressed air is delivered into compressed air chambers 9 behind the porous walls 8 through inlet conduits 10 supplied with compressed air through a suitable source shown schematically by the arrowed lines 10*a*. The air chambers 9 extend for the width of the charging chamber 3 to cause a uniform fluidizing flow of air through the walls 8.

The material thus accelerated and fluidized, passes downwardly through the charging slot 4 into the gap between the rollers 1 and 2. As the material is comminuted, it passes downwardly between the rollers and enters a guide channel 11 extending vertically downwardly, which channel leads to a second similarly constructed comminution system. A further separation of the charging material descending downwardly through the channel 11 is provided to remove the fine particles. This removal of fine particles eliminates their chance of being reground and made further fine and also reduces the briquetting effect. As the material flows downwardly, it is encountered by a cross-flow of separation air shown schematically by the arrowed line 12 flowing into the channel 11 through a conduit 13 and carrying the fine particles with it through an outlet channel 14. Other types of separation devices may be provided. The material then descends downwardly into a second charging chamber 3' having similar porous walls 8' to further fluidize the material. Compressed air is fed through the porous walls 8' from compressed air chambers 9'. Additional entraining jets may be provided, but are shown omitted from the arrangement in FIG. 1. The second set of comminuting rollers is shown at 1' and 2'.

Figure 2:
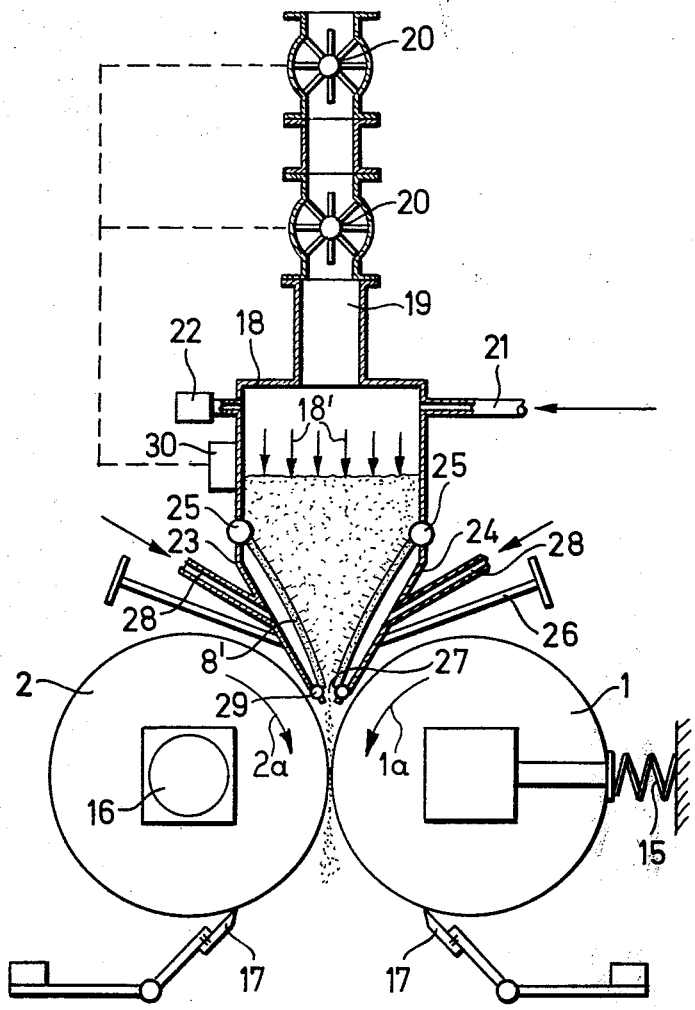

FIG. 2 shows a further embodiment for carrying the method and principles of the present invention to obtain fine comminution. The charging material has a grain size, for example, of a maximum of 1 mm. The rolling mill is constructed so that the roller 1 of FIG. 2 is a floating roller which is provided with a support to permit horizontal movement toward the second roller 2. The floating mounts are so supported so as to be pressed toward the second roller as illustrated by the schematic springs 15. The force pressing the rollers together may be adjustably controllable to operate as a function of the rate of feed of the material. A hydraulic backup piston and cylinder arrangement may be used as will be appreciated. The roller 2 is fixedly rotatably supported, and in accordance with the present arrangement, is the sole driven roller driven by a mechanism shown schematically at 16. Roller 1 will be a freely rotating roller. By this relationship between rollers, the wear behavior of the roller has been found to be substantially improved. Where only the roller 2 is driven, and the roller 1 is actuated by the roller 2 and by frictional contact with the particles passing through the gap, the results in both rollers is slight slippage which, in cooperation with the material disposed in the gap, aids in obtaining uniform wear which is necessary to uniform comminution. Further, the fluidized high speed charging of the material into the gap makes it more possible not to drive one of the rollers by an external drive means. Also, the reciprocating movement of roller 2 prevents the formation of grooves or ridges so that the operating life is greatly improved even with greatly abrasive materials. Doctors 17 are provided below the roller gap for scraping and cleaning the surfaces of the rotating rollers which rotate in the direction indicated by the arrowed lines 1*a* and 2*a*. In this embodiment charging is accomplished by a pressure container 18 into which the material is introduced through the material conduit 19. The charging container 18 is pressurized and, therefore, consecutively positioned material pressure locks are provided for supplying the material downwardly. These pressure locks are controlled by the pressure and the level of material in the chamber 18 and a control 30 is shown with broken line controls leading to the rotor locks 20 for controlling their speed of operation. The pressure charging container 18 is charged through an air pressure conduit 21, and a pressure relief outlet 22 is provided to maintain uniform desired predetermined pressure in the chamber 18.

The pressure chamber 18 has lower tapered side wall assemblies 23 and 24, and these are pivotally supported at their upper ends 25 so that the size of the delivery slot 27 may be adjusted. Power means 26 are provided for swinging the walls and thereby adjusting the slot size. The walls are laterally pivotal and have perforate porous portions shown at 8' which operate similar to the construction described in connection with FIG. 1. These porous walls are apertured, being constructed of a porous material, so that air under pressure flows into the material in the container 18 to fluidize the bed which is continually pressed downwardly due to the pressure above the bed as shown by the arrowed lines 18'. This, in essence, causes the material to squirt out through the slot 27 at a velocity suitable to enter the gap, which velocity approaches or substantially is equal to the surface speed of the rollers 1 and 2. For additionally entraining the material and carrying it into the gap between the rollers, additional air nozzles 29 are spaced all along both sides of the slot 27. These nozzles are connected to a suitable air supply and can be independently pressure controlled, and the nozzles are positioned so that they face directly into the gap. The level of material and the pressure above the material is controlled by the control 30. The pressure in the chambers behind the porous walls is maintained by controlling the air supplied through the conduits 28 and this insures the fluidization of the material and flow at a uniform rate into the gap. The material is essentially accelerated in the pressure chamber and as it passes through the slot, it is further accelerated by the air jets 29 so that it reaches the roller gap with a speed that corresponds approximately to the circumferential speed of the grinding rollers. The comminuted material falls downwardly and is transported away by separate means, not shown.

We claim as our invention:

1. A method of comminution for the reduction of solid materials with a rolling mill having parallel grinding rollers with a grinding gap therebetween rotating toward each other into the gap, comprising the steps:

directing the charging material directly into the roller gap uniformly distributed along the length of the rollers at a high velocity substantially at the velocity of surface movement of the rollers;

and fluidizing the material immediately before directing it into the roller gap by delivering air distributed throughout the material so that air and material pass into the gap and the material is in a fluidized state at entry into the gap.

2. A method of comminution for the reduction of solid materials with a rolling mill having parallel grinding rollers with a grinding gap therebetween and rotating toward each other into the gap in accordance with the steps of claim 1:

including applying air pressure to the material forcing it toward the gap.

3. A method of comminution for the reduction of solid materials with a rolling mill having parallel grinding rollers with a grinding gap therebetween and rotating toward each other into the gap in accordance with the steps of claim 1:

including removing the fine portions of material before fluidizing and before passing through the gap preventing compaction and briquetting between the rollers.

4. In a roller mill for the fine comminution of solid materials such as mineralic loose or bulk materials, having a delivery device arranged above a pair of rollers with a gap therebetween and the delivery device having a material discharge slot extending over the entire length of the roller gap and being provided with means for accelerating charging material to a speed on the order of the circumferential speed of the rollers, the combination characterized by:

opposed walls for the charging device extending the width of the material discharge slot, said walls having openings for the introduction of fluidizing air into the material;

and means for delivering pressurized air through said openings into the material so that the material is fluidized and fluidized material is fed into the slot and between the rollers at substantially the speed of surface travel of the rollers.

5. A roller mill constructed in accordance with claim 4: wherein said opposed walls are formed of a porous elastic material.

6. A roller mill constructed in accordance with claim 4:

wherein said charging device is closed and pressurized and means is provided to deliver compressed air above the material in said charging device.

7. A roller mill constructed in accordance with claim 4:

wherein means is provided for adjusting the size of said material discharge slot.

8. A roller mill constructed in accordance with claim 4:

including a second delivery device positioned below said pair of rollers having a charging device with opposed porous walls and means for delivering air through the walls for fluidizing the material received from said rollers;

and including a second pair of rollers beneath said second delivery device receiving material from a slot at the lower end of said second delivery device.

9. A roller mill constructed in accordance with claim 4:

including means for screening the material prior to delivery to said delivery device, removing fine material sufficiently fine to be regarded as finished product before entering the delivery device.

* * * * *